US006895619B1

(12) United States Patent
Lee

(10) Patent No.: US 6,895,619 B1
(45) Date of Patent: May 24, 2005

(54) FOLDABLE PILLOW

(76) Inventor: Dennis Gun Lee, 3874 S. Truckee Ct., Aurora, CO (US) 80013

( * ) Notice: Subject to any disclaimer, the term of this patent is extended or adjusted under 35 U.S.C. 154(b) by 0 days.

(21) Appl. No.: 10/714,334

(22) Filed: Nov. 14, 2003

(51) Int. Cl.[7] ..... A47G 9/10
(52) U.S. Cl. ..... 5/636; 5/640; 5/630
(58) Field of Search ..... 5/420, 691, 903, 5/491, 722, 630, 632, 738, 499, 636, 637, 640, 490

(56) References Cited

U.S. PATENT DOCUMENTS 2,884,652 A * 5/1959 Paolicelli ..... 5/484
3,174,163 A * 3/1965 Gibson ..... 5/640
3,604,026 A 9/1971 Scheips
4,419,779 A 12/1983 Janesh
4,768,247 A * 9/1988 Beier ..... 5/640
5,157,799 A * 10/1992 Aird ..... 5/490
5,271,114 A * 12/1993 Kjersem ..... 5/640
5,297,304 A * 3/1994 O'Sullivan ..... 5/630
5,535,467 A * 7/1996 Ciske ..... 5/636
5,797,154 A 8/1998 Contreras
5,802,644 A * 9/1998 Scheurer ..... 5/640
5,987,676 A * 11/1999 Littleford et al. ..... 5/636
6,023,798 A * 2/2000 Hui ..... 5/490
6,065,164 A * 5/2000 Swanger et al. ..... 5/420
6,267,638 B1 * 7/2001 Connolly et al. ..... 446/73
6,442,778 B1 * 9/2002 Shaharbani ..... 5/636
2002/0138908 A1 10/2002 Wang

* cited by examiner

*Primary Examiner*—Michael Trettel
(74) *Attorney, Agent, or Firm*—Kurt Leyendecker; Leyendecker Lemire & Daley, LLC

(57) ABSTRACT

A pillow that can be folded or rolled into a plurality of configurations is described. Preferred embodiments of the pillow typically comprise an elongated viscoelastic foam pad that can be evenly folding into half, thirds or quarters to create a formed pillow of varying thicknesses. Additional configurations are possible by rolling the pad or unevenly folding the pad. A pillow covering can also be provided that is longer than the foam pad such that the excess portion of the covering can be tucked under the formed foam pad to hold the pillow in its formed configuration. Because of its customizability, the pillow is adaptable for use by all types of sleepers including back sleepers, side sleepers, stomach sleepers and sleepers who switch sleeping positions during the night.

19 Claims, 6 Drawing Sheets

FOLDABLE PILLOW

FIELD OF THE INVENTION

The invention relates generally to pillows, and more particularly to a pillow that can be folded over on to itself or rolled up into various configurations to suit the particular desires of the person using the pillow.

BACKGROUND

In the last decade or so, a significant amount of attention has been focused on sleeping and in particular how are sleep comfort effects a person's ability to get a good nights sleep. Experts have recognized that there is no common preferred sleep position or sleeping surface that will be equally comfortable to all people in terms of how well they sleep. Rather, different people require different sleep surfaces and sleep positions to get a good nights rest. One person may sleep best on his/her stomach on a soft mattress, while another person may sleep best on his/her side on a medium firm surface, and yet another person may sleep best on his/her back on a very firm surface. Furthermore, the same person may vary his/her sleep habits on a periodic basis. For example a person may sleep on his/her back one night, his/her stomach the next night, and his/her side another night. In each sleep position, different firmness sleep surfaces may be required by even the same person to maximize his/her comfort.

Thankfully, mattress companies have recognized the differences in how different people sleep and have brought mattresses to the market in which the sleeper can adjust the firmness of the mattress on an as-needed basis. For example, one company sells a mattress in which the users can adjust the pressure level of air contained in air bladders in the mattress to adjust the mattress's firmness. Other companies offer beds that can be independently tilted at various locations resulting in a myriad of configurations. Never in history has the consumer's ability to change the characteristics of his/her sleep surface been so great.

Unfortunately, pillow technology has not kept pace with mattress technology, and accordingly, there are very few if any pillows for sale in the marketplace that are user easily user customizable and adjustable. Pillows, however, just like mattresses can greater effect how well a person sleeps. Some people prefer thick soft pillows. Others prefer relatively thin pillows. Others, who regularly switch between different sleeping positions, may desire to have pillows of differing thicknesses and levels of firmness readily available to accommodate two or more different sleeping positions.

To make matters worse, hotels rarely offer the guest more than a single pillow choice. Depending on the patron of a hotel, the supplied pillows may be too thick, to thin, or not supportive enough. Probably as often as hotel patrons cannot sleep because of the type of mattress provided, other patrons fail to get a good nights sleep well because the provided pillows are uncomfortable to them.

The typical standard pillow has been around for a long time and is still in use by a majority of people in the United States. Referring to FIG. 1, a typical rectangular pillow 10 comprises top and bottom sheets 15 & 20 of fabric that are sewn together along its edges 25. The resulting enclosure is filled a stuffing 30 materials such as, but not limited to, polyester fiberfill, feathers, cotton batting and foam particulate. The type and amount of filling material determines the pillow's firmness and loft.

As shown in FIG. 2, a traditional pillow 10 is thickest at its center 30 thinning towards each of it four edges 25.

Because of this thinning toward its edges, the traditional pillow typically does not provide full support to the nape 45 of a person's neck 35 when a person 40 is sleeping on his/her back as illustrated in FIG. 3. Rather, it leaves a gap 45 between the top of the pillow and the nape of the neck that increases the strain on the neck. It is appreciated excessive neck strain can cause a person to wakeup with a stiff neck.

Additionally, in higher loft traditional pillows 10 that are filled with a fibrous polymeric material such as polyester, compression of the center of the pillow causes both the filler to be pushed towards the edges of the pillow and the fibers in the filler that extend from the portion of the pillow compressed by a person's head and the portion behind the head to become tensioned. The tension developed in these fibers causes a force 50 to be exerted on the rear 55 of the head generally forcing it upwardly and rotating the person's chin 60 generally counterclockwise. This can also cause neck discomfort and cause a person to wakeup with a stiff neck 35.

Various types of pillows have been produced that minimize or eliminate the problems associated with traditional pillows. For instance, U.S. Pat. No. 5,271,114 teaches a generally traditional pillow that is divided into two portions with one portion being of a different length than the other portion. A pillow case is provided that includes strategically positioned snap so that the pillow can be partially folded over on to itself at the intersection of the two portions and secured, thereby creating a thicker section to support a person's neck. While this pillow is an improvement for a back sleeper who needs better neck support, it is not an ideal pillow configuration for a side or stomach sleeper that does not require neck support. Further, such a pillow would not serve a person that switches their sleeping positions during the night.

Another type of pillow that has become popular is the contoured foam pillow, which is often comprised of a unitary block of viscoelastic foam material such as the pillow described in U.S. Pat. No. 5,797,154 of Contreres and the pillow described in U.S. Pat. No. 5,802,644 of Scheurer. These types of pillows define a trough that receives the back of a person's head. A thicker section is provided to support the person's neck. Further, because of the nature of viscoelastic foam material, the pillow tends to support the head more evenly than a traditional pillow. However, there are several drawbacks to contoured viscoelastic foam pillows.

First, contoured viscoelastic pillows are designed primarily for back sleepers and are typically not suitable for stomach, side or position-switching sleepers. Next, viscoelastic foam is well known for absorbing and retaining heat. As a sleep period progresses, a viscoelastic foam pillow will absorb heat from a person's head potentially making the pillow uncomfortably warm.

Also, the typical contoured viscoelastic foam pillow comprises two ridges proximate either edge of the pillow where the foam is relatively thick and the trough or area of lower thickness therebetween. In use, a user places his/her head in valley with one of the ridges situated underneath the neck for support thereof. The ridges are typically of different thicknesses, so the user is able to choose the one ridge that best suits his/her preferences. Unfortunately, the ridge that is not being used to support the neck is situated behind the back of the head and the unused ridge cause a force 50 to be exerted on the rear 55 of the head generally forcing it upwardly and rotating the person's chin 60 generally towards his/her chest.

Finally, like the other types of pillows described above, contoured foam pillows are not user adjustable or customizable. For instance, while the pillow of Scheurer can be compressed and rolled up for travel purposes, a special compression "Tapper with hook and loop fasteners is required to hold the pillow in this alternative configuration. Certainly, however, the rolled-up configuration with the foam highly compressed and a wrapper covering the pillow would be unsuitable for use to sleep or to comfortably lie upon.

SUMMARY OF THE INVENTION

One preferred embodiment of the present invention is a pillow comprising a generally rectangular pad and textile pillow covering. The pad includes a substantially planer top surface parallel and spaced from a substantially planer bottom surface by the pad's thickness. The length of the pad is at least seventy five percent longer than the pad's width. The pad also has first and second side surfaces extending between respective lengthwise edges of the top and bottom surfaces, and third and fourth side surfaces extending between extending between respective widthwise edges of the top and bottom surfaces. The pillow covering substantially encapsulates the pad and has a pillow covering length that is substantially longer than the pad length.

Another preferred embodiment of the invention comprises a combination of a pillow and instructions on how to fold or roll the pillow into three or more configurations. The pillow includes a generally rectangular viscoelastic foam pad. The pad has (1) a substantially planer top surface, (2) a substantially planer bottom surface generally parallel to and spaced from the top surface by a pad thickness of about 0.75" to 1.75", (3) a pad length of about 44" to 52", and (4) a pad width. The pad length is at least seventy five percent longer than the pad width.

Yet another preferred embodiment of the present invention is a method of using a flat pillow. The flat pillow comprises a rectangular pad having generally planer generally parallel top and bottom surfaces separated by a thickness of no more than two inches. The length of the pillow is at least seventy five percent longer than the pillow's width. The method comprises forming the pillow by performing one of the following operations: (1) generally evenly folding the pillow widthwise over on to itself at two locations tripling a height of the pillow; (2) generally evenly folding the pillow widthwise over on to itself at three locations quadrupling the height of the pillow; and (3) first folding the pillow widthwise at one or two locations wherein the one or two locations are a relatively short distance from on widthwise edge of the pillow, and then generally evenly folding the remaining length of the pillow over on to itself at two locations, whereby the pillow is tripled in height over one portion and is either quadrupled or quintupled in height over another portion. Next, a user positions the pillow on a sleeping surface. Finally, the user lays down on the sleeping surface and places his/her head on the formed pillow.

Numerous other embodiments and variations of the embodiments are also contemplated as is provided in this specification including the appended claims and as would be obvious to one of ordinary skill in the art with the benefit of this disclosure.

DETAILED DESCRIPTION

A new type of pillow and methods for using the pillow are described herein. Embodiments of the pillow of the present invention are easily user adaptable and customizable such that a person can form the pillow into any one of a plurality of configurations that is most comfortable for the person considering the person's intended use of the pillow. Accordingly, most back sleepers, stomach sleepers, side sleepers and switch-position sleepers alike can configure embodiments of the present invention to provide them with a comfortable and satisfying nights sleep.

Terminology

The term "or" as used in this specification and the appended claims is not meant to be exclusive rather the term is inclusive meaning "either or both".

The phrase "viscoelastic foam" as used in this document refers in general to a class of foams that exhibit viscoelastic behavior when compressed. These foams are also known as "memory cell foam" or memory foam". Typically, viscoelastic foams are open cell foams made from polyurethane, although the use of the term herein is intended to broadly describe any foam exhibiting significant viscoelastic behavior whether or not the foams comprise polyurethane.

The terms "cutaway" and "cutout" as used in this document refer to an area that differs from its surrounding because of its lack of material. For instance as used herein, cutouts or cutaways refer to areas of foam or foam padding that appear to have had foam removed therefrom. While cutaways and cutouts may be produced by actually cutting or removing material from a certain area, the terms are not meant to be so limiting. For instance, cutouts and cutaways can be produced during the formation of a foam pad or a foam block.

A First Preferred Embodiment of the Pillow

Figure 1:
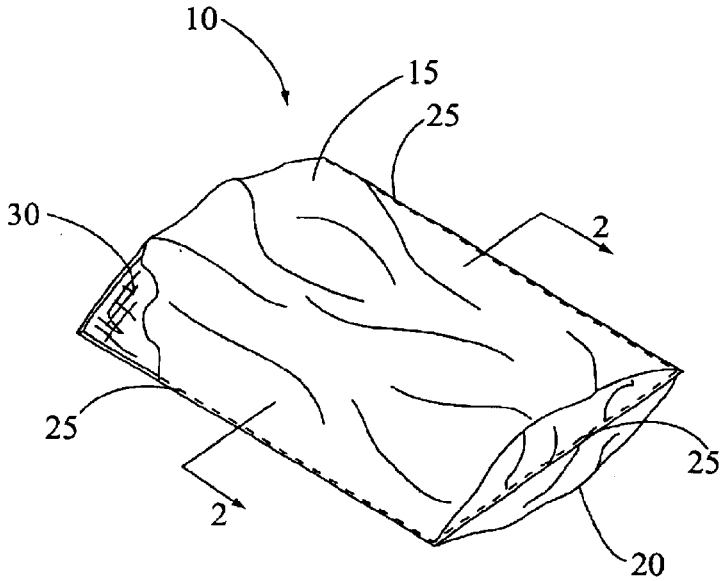
FIG. 1 (PRIOR ART)
FIG. 1 is an isometric illustration of a traditional prior art pillow.
Figure 2:
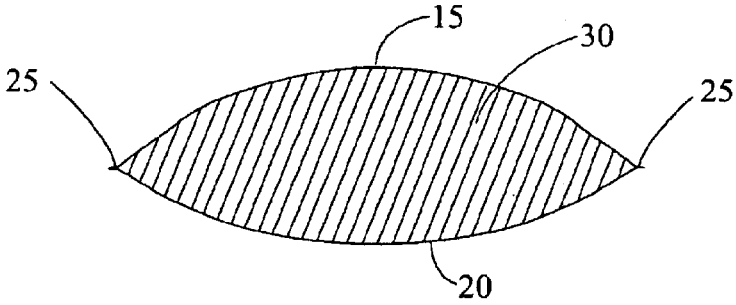
FIG. 2 (PRIOR ART)
FIG. 2 is a side view of the prior art pillow taken along line 2—2 of FIG. 1.
Figure 3:
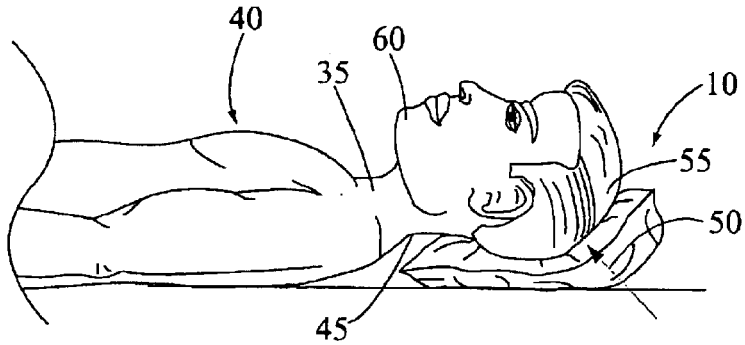
FIG. 3 (PRIOR ART)
FIG. 3 is side view of a person lying on a traditional prior art pillow.
Figure 4:
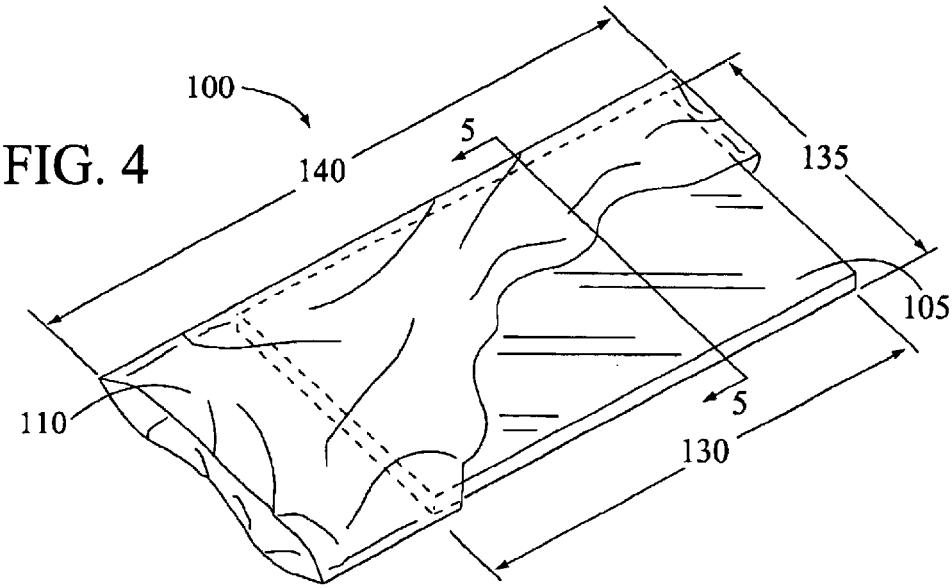
FIG. 4 is an isometric illustration of a first preferred embodiment of the present invention.
Figure 5:
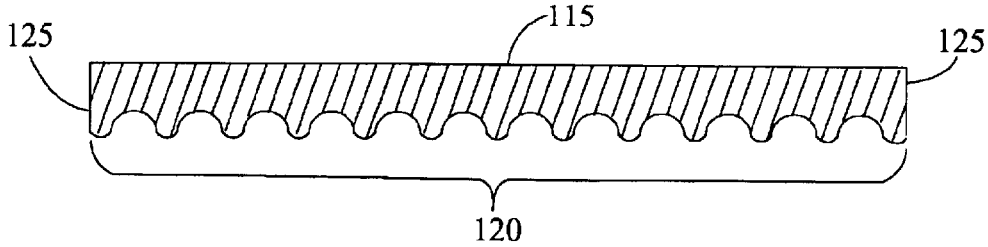
FIG. 5 is a side view of the foam pad of the first preferred embodiment taken along line 5—5 of FIG. 4.

Referring to FIGS. 4 & 5, a first preferred embodiment 100 of the pillow comprises a viscoelastic rectangular foam pad 105, and an associated pillow covering 110 encapsulating the foam pad. The length 130 of the pad is much greater than its width 135. The extended length and the nature of the viscoelastic foam material permits the pillow to be easily folded or rolled permitting a person to customize the pillow into one of a variety of configurations that is most comfortable for him/her.

The foam pad 105 of the first preferred embodiment 100 is typically 0.50" to 2.0" thick, more preferably 0.75" to 1.50" thick, and most preferably about 0.85" to 1.25" thick. The pad typically has a length 130 of 40" to 60", more preferably 44" to 52", and most preferably about 46" to 48". The pad's width is typically 16" to 30", more preferably 18" to 25", and most preferably 20" to 22". The pad has substantially planer top and bottom surfaces 115 & 120 that are generally parallel to each other.

In certain variations of the foam pad 105, both the top and bottom surfaces 115 & 120 are smooth and in other variations, one or both of the surfaces are textured and/or convoluted. Referring to FIG. 5, the bottom surface 120 is shown having an eggcrate texture. It is to be appreciated that many other textures that can be specified. In variations with two distinct surfaces, a user is provided with an additional degree of customizability. If the user prefers laying his head on a textured surface opposed to a smooth surface, he/she can merely flip the pillow over and fold or roll it in such a manner that the eggcrate or textured surface is upwardly facing. Conversely, if the user prefers a smooth surface he can situate the textured surface to be facing downwardly on the top folded or rolled layer of the formed pillow.

Figure 8:
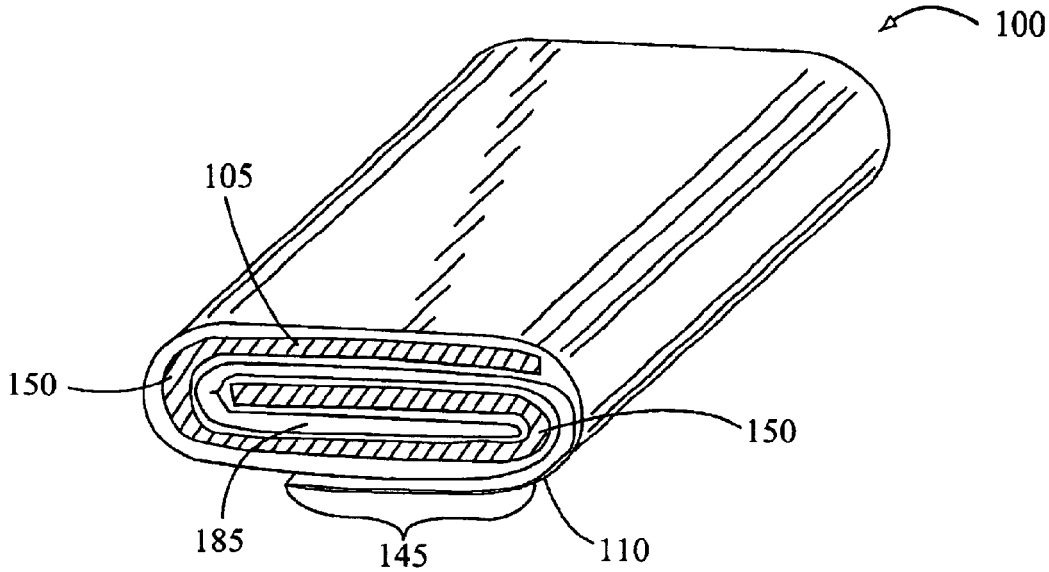
FIG. 8 is an isometric view of the first preferred embodiment shown in one of its folded configurations with the end thereof cutaway to illustrate the configuration of the foam pad.
Figure 9:
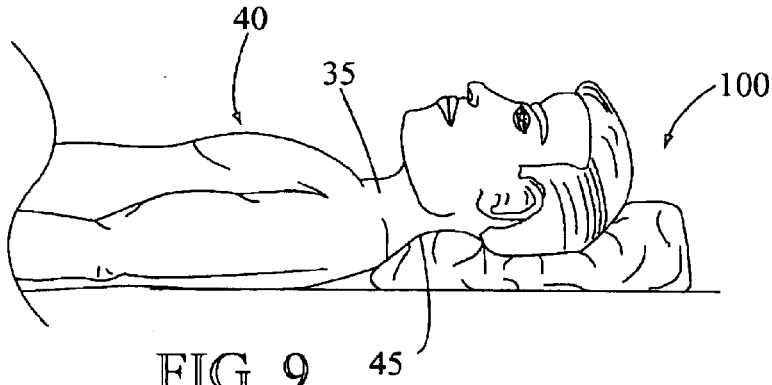
FIG. 9 is a side view of a person lying on a folded configuration of the pillow of the first preferred embodiment.
Figure 10A:
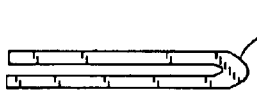
FIGS. 10A–10E are sectional side views of the foam pad from the first preferred embodiment showing the various possible configurations of the pillow.
Figure 10B:
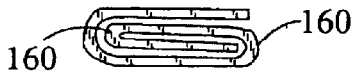

The top and bottom surfaces 115 & 120 intersect with and are bounded by lengthwise and widthwise extending side surfaces 125 at their respective lengthwise and widthwise edges. Typically, the side surfaces are generally perpendicular to the top and bottom surfaces, although not necessarily in all variations of the foam pad 105. By having square edges and side surfaces that are perpendicular to the top and bottom surfaces, a resulting evenly folded pillow has a similar effective thickness near its edges as it does in its middle. FIGS. 8, 10A, & 10B illustrate different configurations that can be formed by evenly folding the first preferred embodiment. In other words, except for the minor variations in thickness at a folded pillow's widthwise edges caused by folding the pad, an evenly folded pillow of the first preferred embodiment will have substantially the same thickness over its entire surface. Accordingly, since the thickness does not taper near the folded pillow's edges, the neck of a user is better supported as illustrated in FIG. 9 when compared to a traditional pillow 10. For ease of illustration, the various folds of the pillow have been purposely emitted from FIG. 9. The various formed configurations of the first embodiment are described in greater detail herein below.

As mentioned above, the preferred variations of the foam pad 105 are comprised of a viscoelastic foam material. In other embodiments of the pillow, other foams such as latex foams and closed cell polyurethane foams can be utilized. Additionally, pads comprised of a quilted or formed fiberfill material can be used in other pillow embodiments. However, the viscoelastic foams are several distinct advantages over other types of foam and padding materials. Namely, because of their low resilience, viscoelastic foam pads are more likely to stay in their folded or rolled configuration than high resilience elastic foams that tend to spring back from whatever deformed configuration they are placed in. Further, viscoelastic foams are well known in the art for evenly distributing a load, such as a person's head, placed upon them over the entire area of the load's contact with the foam. It is this property of viscoelastic foams that make them desirable for use in human support applications, such as pillows and sleep surfaces. Effectively, the foam acts to eliminate or at the very least minimize pressure points. Viscoelastic foam is produced in a number of densities. For use in the pillow of the first preferred embodiment, a foam having a density from about 2 to 5.5 pounds is preferred, a density from about 2.5 to 4.5 pounds is more preferred and a density of around 3 pounds is most preferred.

The pillow covering 110 of the first preferred embodiment typically comprises a woven fabric comprised of natural or synthetic fibers. However, in variations the pillow covering can comprise a non-woven fabric material as well. The covering typically comprises an envelope wherein one of its widthwise edges forms an opening into which the foam pad 105 is received. As clearly illustrated in FIG. 4 the width of the covering is typically slightly wider than the foam pad 105 as is necessary to facilitate sliding the foam pad into the covering, but the covering has a substantially longer length 140 than the foam pad. Typically, the pillow covering is preferably at least 20% longer than the foam pad, more preferably at least 25% longer, and most preferably at least 30% longer. One purpose of the longer pillow covering is best described with reference to FIG. 8, which illustrates the first preferred embodiment evenly folded into a formed pillow that is three layers of foam pad in height (or loft). As shown, the portion 145 of the pillow covering that extends beyond the end of the folded pad 105 is wrapped underneath the rest of the formed pillow between the bottom side of the pillow and the surface on which the pillow rests. Accordingly, the weight of the pillow on the extended portion of the covering acts to hold the folded pad in place so that the formed pillow does not spontaneously unfold when the weight of a user's head is removed from the pillow.

An alternative pillow covering (not shown) is also contemplated that comprises two distinct sections (or pieces) that are joined together typically with corresponding portions of book and loop material. The first section comprises an envelope that is slightly larger than the pad 105 to substantially enclose the pad therein. A tape of either the hook or the loop portions of the hook and loop material is attached to the first section along the inside surface of the open end proximate the associated edge(s). The second section comprises an extended section of woven or non-woven fabric material that has a width generally the same as the first section. The other of the hook and loop portions is attached to the second section proximate one of the widthwise edges thereof. Accordingly, the two sections can be joined together to form an alternative pillow covering with a pillow covering length that is substantially longer than the length of the foam pad 105.

Numerous variations of the first preferred embodiment are contemplated. For instance, in one variation the pillow covering 110 is not provided and the pillow comprises only the foam pad. It is appreciated that in many of the possible formed configurations of the pillow, the pad will remain in its folded configuration without a pillow covering or a pillow covering with an extended portion 145, especially when the pad is comprised of a low resilience viscoelastic foam material. In another variation, the pillow covering may comprise a traditional pillowcase, which is slid over the foam pad after the pad is formed into the desired configuration. In yet another variation, the extended portion 145 of the pillow covering may in and of itself form an envelope into which the pillow can be slid once after it is folded to more securely ensure the folded pillow retains its folded and/or rolled shape. In even yet another variation, the pillow covering can include strategically positioned fasteners, such as several hook and loop material patches located proximate the lengthwise edges of the covering, to secure the pillow in a desired formed configuration.

Pillow Configurations

FIGS. 8 & 10A–E illustrate several of the various configurations of the first preferred embodiment pillow 100. For clarity the pillow covering 110 is not illustrated in FIGS. 10A–E. All of the illustrated configurations show a pad that has been folded or rolled over onto itself one or more times. While all the layers will be substantially in contact with each other through the pillow covering fabric (if a pillow covering 110 is utilized), they will not necessarily be in contact towards the edges of the pillow, thereby defining air pockets 185 between the layers as best shown in FIG. 8. While the pillow is in use, natural convective forces cause air to flow in and out of the air pockets whisking away heat from the foam pad, thereby lowering the temperature of the pillow and permitting a user to sleep in greater comfort.

FIG. 10A shows a sectional side view of the foam pad 105 that has been folded evenly in half at a single fold 155 such that the widthwise side surfaces 125 of the pad are substantially adjacent to each other. The resulting formed pillow has a height equal to twice the thickness of the pad. Stomach sleepers may prefer this configuration. When lying on in the stomach down position, the user's head is preferably located proximate the fold 155 with the user's upper chest located proximate the other end of the pillow. Accordingly, the pillow in this configuration not only supports the user's head but his/her chest as well.

FIG. 8 shows an isometric sectional side view of the foam pad 105 that has been evenly folded at two widthwise folds 150 into thirds such that the widthwise side surfaces 125 of the pad are positioned on either sides of the formed pillow. The resulting formed pillow has a height equal to three thicknesses of the pad. Back sleepers, who don't want a pillow with a lot of loft may prefer this configuration. When a user's head is properly positioned the user's head will sink into the pillow several inches and be gently cradled. Unlike traditional poly fiberfill pillows, no appreciable forces are induced by the viscoelastic foam to cause the user's head to rotate towards his/her neck. Further as shown in FIG. 9, the pillow will provide additional support to the user's neck 45 when compared to a traditional pillow 10.

FIG. 10B shows a sectional side view of the foam pad 105 that has been folded into quarters at three widthwise folds 160 such that the widthwise side surfaces 125 of the pad are located along the same side of the resulting formed pillow. The resulting formed pillow has a height equal to four thicknesses of the pad. Back sleepers, who prefer a pillow with a medium amount of loft, may prefer this configuration. Additionally, side sleepers may also prefer this configuration since side sleepers often prefer a pillow with greater loft (or height). This configuration supports and cradles a user's head in much the same manner as the pillow configuration of FIG. 8 except the user's head is elevated approximately 33% higher.

Figure 10C:
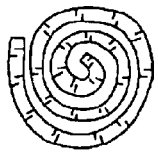

FIG. 10C shows a sectional side view of the foam pad 105 that has been rolled up. There are essentially two variations of the rolled up configuration. In the first rolled-up configuration, the pillow is rolled up rather loosely creating a roughly cylindrical pillow having a loft approximately equal to 5 or so thicknesses of the foam pad. In this form, the pillow is typically most suited to a back sleeper who prefers a high amount of pillow loft. In the second configuration, the pillow is tightly rolled up creating a pillow (1) in which the layers of viscoelastic foam are at least partially compressed and (2) that has a smaller diameter than the first rolled-up configuration. In this form, the pillow is most suited to therapeutic uses such as, but not limited to, providing neck support to a person in a sitting position.

Figure 10D:
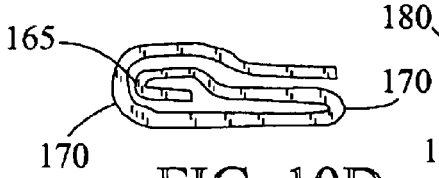
Figure 10E:
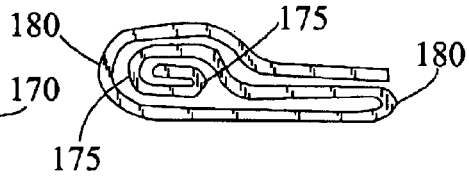

FIGS. 10D and 10E illustrate two variations of a neck support pillow. These configurations are adapted for users who have neck or back problems and need extra support that the other pillow configurations cannot provide. Referring first to FIG. 10D, the pillow is folded once along a widthwise fold 165 proximate one end of the foam pad. The remaining length of pad is then evenly folded back on to itself in thirds at two folds 170. The resulting pillow has a 4 layer thick section that is typically positioned under the user's neck and a three layer thick section that is positioned under the user's head. Referring to FIG. 10E, the pillow is folded twice along widthwise folds 175 proximate one end of the foam pad. The remaining length of pad is then evenly folded back on to itself in thirds at two folds 180. This resulting pillow has a 5 layer thick section that is typically positioned under the user's neck and a three layer thick section that is positioned under the user's head. Advantageously, a user of the first embodiment pillow 100 who needs additional neck support can adjust the pillow to his/her specific support needs. Conversely, pillows made of blocks of foam are not adjustable and a person may have to purchase several pillows before he/she identify one that is suitable for his/her needs.

The aforementioned configurations are not exhaustive of all the potential configurations of the first preferred embodiment pillow. Rather, the number of potential configurations is very large and dependent on the multiple ways in which the pillow can be folded or rolled. Furthermore, by merely flipping the pillow over to expose a textured or eggcrate surface opposed to a smooth surface, the number of total configurations is doubled. Ultimately, unlike other pillows currently in the market, the first preferred embodiment is adjustable and customizable by most people into a configuration that will maximize their level of comfort. Furthermore, it is the only pillow that can adjust on the fly for the difficult to please switch-position sleepers. For example, a switch-position sleeper may start out sleeping on his/her back using the pillow of FIG. 8, but when he/she switches in the middle of the night to a side sleeping position, the user can quickly reconfigure the pillow to one of the configurations of FIG. 10B or FIG. 10C, which give additional loft. Prior to the present invention, the switch-position sleeper would have had to make due with a single compromise pillow or have two or more pillows available to accommodate his/her different sleeping positions.

A Second Preferred Embodiment of the Pillow

Figure 6:
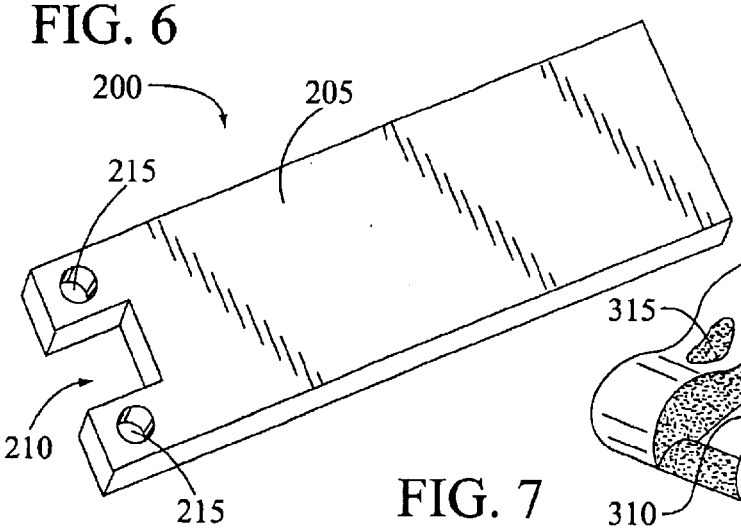
FIG. 6 is an isometric illustration of a second preferred embodiment of the pillow.

FIG. 6 illustrates a second preferred embodiment 200 of the invention. In general, the second preferred embodiment comprises a pad 205 of similar materials and dimensions as the pad 105 of the first preferred embodiment 100. Further, although a pillow covering is not illustrated concerning the second preferred embodiment, one similar to the pillow covering 10 described above can be used. However, unlike the first preferred embodiment 100, the pad 205 of the second preferred embodiment includes several cutaway sections located proximate a widthwise end of the pad.

A head cutaway section 210 extends inwardly and is centered along the one widthwise edge of the pad. The head cutaway is sized to receive a human head therebetween. Preferably, the cutaway is generally rectangular and is about 12" to 15" long and about 8.5" to 10" wide, although the cutaway can comprise different dimensions and shapes in other embodiments.

A pair of ear cutaway sections 215 is also provided in the portions of the mat on either side of the head cutaway 210. The ear cutaways are each sized to receive an ear therebetween. In the second preferred embodiment, the ear cutaways comprise either circles or ovals having major and minor diameters of about 2"–4", although other sizes and shapes can be utilized as well.

The second preferred embodiment can be folded and rolled into the same configurations as the first preferred embodiment. However, because of the cutaway sections, the resulting pillow has a lower loft or height by one pad layer at its center portion and proximate the ear cutaways. It is to be appreciated that layer containing the head cutaway 210 can be configured as the top, bottom, or middle layer of a formed pillow. Accordingly, when folded into the configuration of either FIG. 8 or FIG. 10B, a pillow is provided that is potentially comfortable to the back and side switch-position sleeper without having to reconfigure the pillow. For example, a switch-position sleeper who prefers a thickness of three layers while sleeping on his/her back would fold the pillow as shown in FIG. 10B. When the person rolls over on the pillow to move into a side sleeping position he/she will roll onto a portion of the pillow having a thicker effective loft or height of four layers that is usually more suited to sleeping on ones side. Ideally, one of the user's ears will be incident on the formed pillow in the region of the ear cutouts 215 thereby reducing any force or pressure that would have otherwise been incident on the ears if no cutouts were provided. In other variations of the second preferred embodiment, the ear cutaways can be omitted.

A Third Preferred Embodiment of the Pillow

Figure 11:
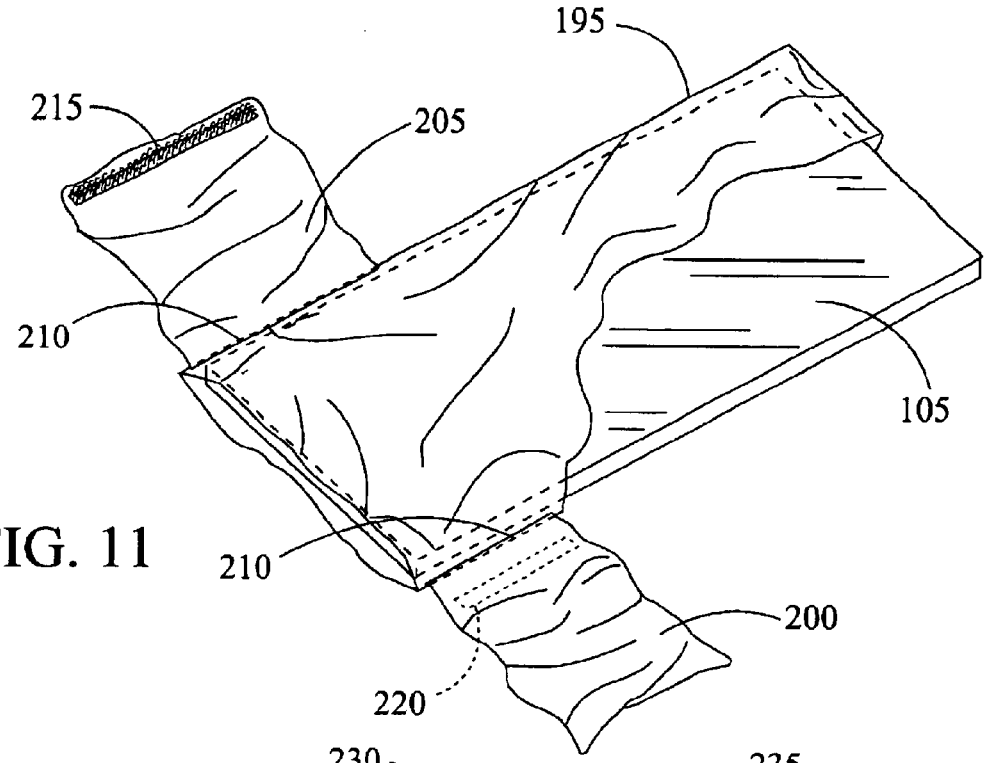
FIG. 11 is an isometric illustration of a third preferred embodiment of the foldable pillow of the present invention.

FIG. 11 illustrates a third preferred embodiment pillow. Generally, the third preferred embodiment uses similar materials as the first and second preferred embodiments. The foam pad 105 is substantially similar to the foam pad of either the first or second preferred embodiments. The primary difference between this embodiment and the proceeding embodiments is the construction of its pillow covering 195. Unlike the covering 110, the pillow covering 255 of the third preferred embodiment is not substantially longer than the associated foam pad 105. Rather, the length of the cover in the third embodiment is typically longer than the pad only by a sufficient amount to substantially cover the foam pad, although in variations the length of the covering could be longer.

The most noticeable distinction between the first and third preferred embodiment pillow coverings is that the pillow covering of the third preferred embodiment includes one or two flaps 200 & 205 that extend laterally from the foam pad. Typically, these flaps are sewn to the primary body of the pillow covering at seams 210. The flaps may also include one or more strips of hook and loop material 215 & 220 attached to thereto. In alternative variations a strip of hook and loop material can also be attached to the primary body of the pillow covering as applicable to receive a strip attached to a flap. The purpose of the flaps is essentially similar to the extended portion of the first preferred embodiment's pillow covering, which is to hold or secure the pillow into a particular folded configuration.

Operationally referring to FIG. 11, a user begins folding the third preferred embodiment pillow from the widthwise end opposite the end adjacent the one or more flaps. Once folded into the desired configuration, the user folds the first flap 200 under the folded pillow, and next, the user folds the second flap 205 underneath the first flap. Finally, the user secures the flaps in place by aligning and coupling the corresponding strips of hook and loop material 215 & 220 on each respective flap.

A Fourth Preferred Embodiment of the Pillow

Figure 12:
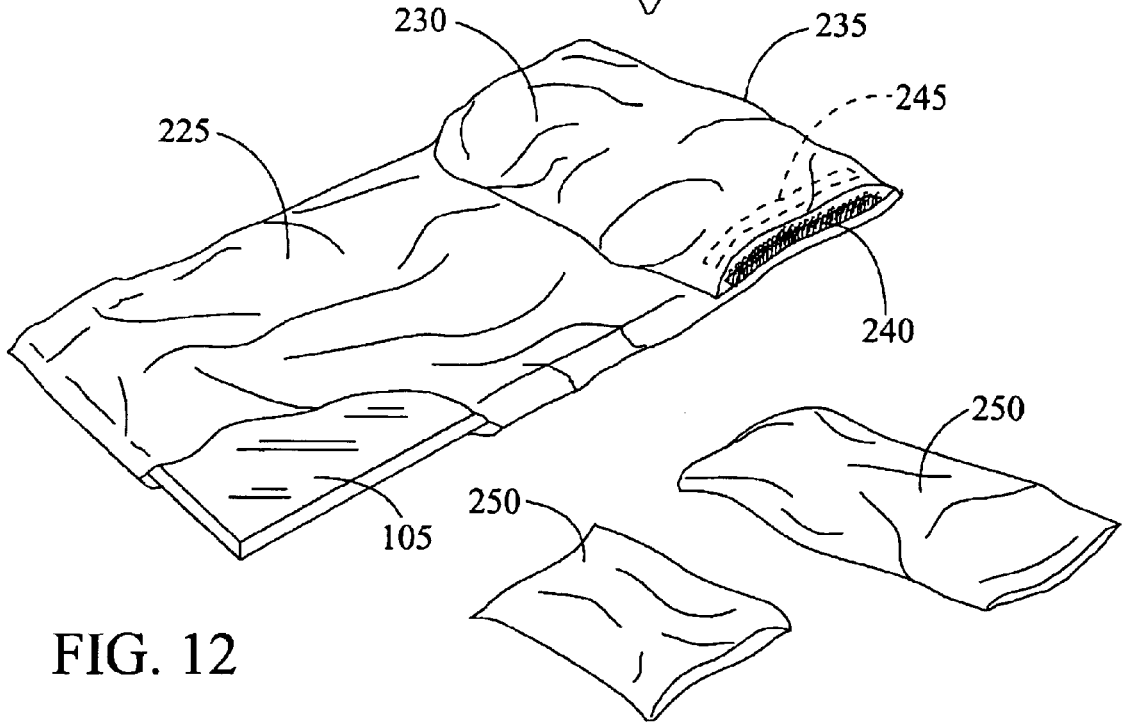
FIG. 12 is an isometric bottom view of a fourth preferred embodiment of the foldable pillow of the present invention.

FIG. 12 illustrates a fourth preferred embodiment pillow. Generally, the fourth preferred embodiment uses similar materials as the first, second and third preferred embodiments. For instance, the foam pad 105 is substantially similar to the foam pad of either the first or second preferred embodiments. Like the third preferred embodiment, the primary difference between this embodiment and the first and third preferred embodiments is the construction of its pillow covering 225. The primary body of the covering is generally similar to that of the third preferred embodiment in that it is typically about the same length or slightly longer than the foam pad contained within it However, near the widthwise end opening 235 in which the foam pad is slid into the covering, the bottom side of the covering includes a pouch 230 sewn or otherwise attached thereto. The pouch typically includes an opening along a longitudinal edge of the covering. Corresponding hook and loop material strips 240 & 245 are typically provided so that the pouch can be closed. The pouch is adapted to hold folded pillowcases 250 of various sizes.

Operationally referring to FIG. 12, a user begins by removing a pillowcase 250 from the pouch 230 corresponding to the size of the pillow once it has been folded. Next, a user begins folding the fourth preferred embodiment pillow from the widthwise end opposite the end opening 235. Finally, the user places the sized pillowcase 250 over the folded pillow in a traditional manner. The pillowcase effectively holds the pillow in its folded configuration.

A Fifth Preferred Embodiment of the Pillow

Figure 13:
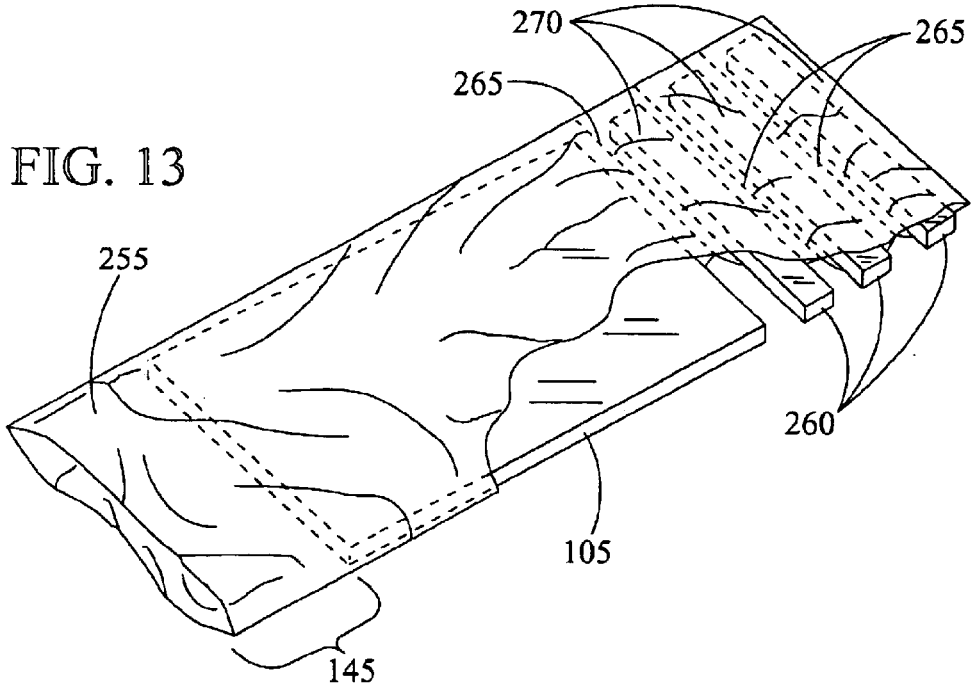
FIG. 13 is an isometric top view of a fifth preferred embodiment of the foldable pillow of the present invention.
Figure 14:
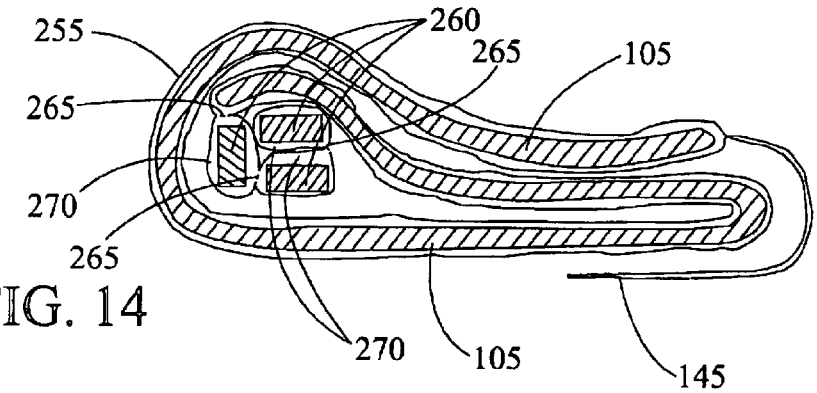
FIG. 14 is a cross sectional side view of the fifth preferred embodiment shown folded into the neck pillow configuration.

FIGS. 13 and 14 illustrate a fifth preferred embodiment pillow. The foam pad 105 of this embodiment is typically several inches shorter than the foam pads of the other embodiments described above. The pillow covering 255 of the fifth preferred embodiment can also extend beyond one widthwise end of the pad 105 such that the extended portion can be tucked under the pillow once the pillow has been folded to hold the folded pillow in place. Other variations may include the pouch and pillowcases of the fourth preferred embodiment or the flaps of the third preferred embodiment.

Adjacent the end of the foam pad opposite the pillow covering's opening, the covering extends therefrom for several inches (typically 6–18") and includes widthwise seams 265 sewn at intervals of about 2–6" to form one or more pockets 270. Foam blocks 260 of essentially the same width as the foam pad 105 are received into the pockets. This configuration is especially suited to forming the pillow into the neck pillow configurations shown in FIGS. 10D & 10E. It is noted that because the foam portions of the pillow 105 & 260 are widthwise segmented at one end of the pillow, the pillow will have less a tendency to spring back or unfold than a neck pillow comprised of a single foam pad, such as the first preferred embodiment.

Operationally, a user begins folding the pillow at the end that includes the foam blocks. The pillow is folded at each seam 265 to in effect form the raised or thicker portion of the neck pillow. Next, the remaining longitudinal length if the pillow is folded in thirds to form a resulting pillow similar to the one illustrated in FIG. 14. Finally, the extended portion 145 of the pillow covering 255 is tucked under the bottom of the folded pillow to help hold the pillow in the desired configuration.

A Sixth Preferred Embodiment of the Pillow

Figure 15:
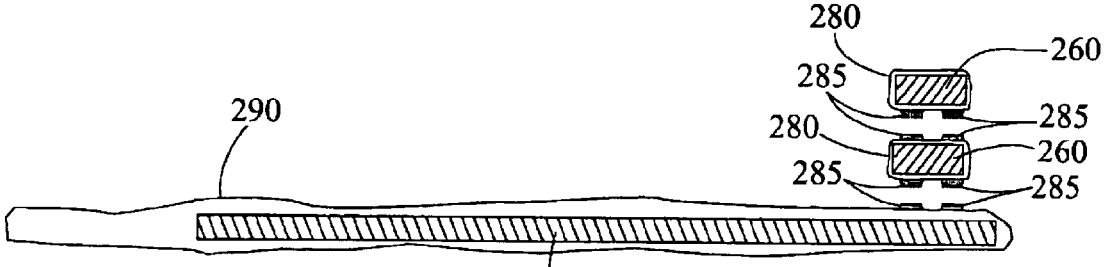
FIG. 15 is a cross sectional side view of a sixth preferred embodiment of the foldable pillow of the present invention.
Figure 16:
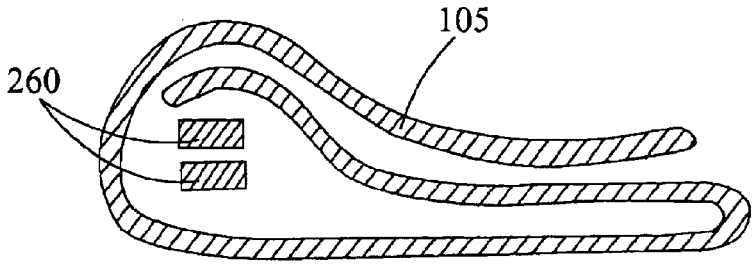
FIG. 16 is a cross sectional side view of the sixth embodiment with the pillow and foam block coverings omitted for clarity.

FIGS. 15 and 16 illustrate a sixth preferred embodiment pillow. Like the fifth preferred embodiment, the sixth preferred embodiment utilizes a number of foam blocks 260 in combination with a shortened foam pad 105 (at least when compared to the foam pad of the first preferred embodiment). However, the foam blocks 260 are each contained in individual block coverings 280 instead of being placed into individual compartments at the end of a covering. Each of the block covers have hook and loop material strips extending widthwise relative to the length of the pad 105 and the pad covering 290. The covering 290 also includes one or more strips of widthwise strips of book and loop material 285 proximate its closed end. Accordingly, one, two or more blocks contained in their respective foam block coverings can be stacked on top of each other to augment the thickness of the neck portion of a neck pillow. In variations, it is appreciated that the pillow covering 290 and the block coverings 280 can also be configured such that the blocks could be placed side by side, as well as, stacked on top of each other. It is to be appreciated that the sixth preferred embodiment has essentially the same advantages as the fifth preferred embodiment in terms of the tendency or reduced tendency of the pillow to unfold when compared to the first preferred embodiment. Either of these embodiments can be especially desirable when the foam material used in the pillow is not memory foam but a more resilient closed cell foam.

FIG. 16 illustrates the blocks in cross section with the coverings not shown for clarity. To form the pillow into the neck pillow configuration, a user first stacks the desired number of covered foam blocks on top of the pillow covering 290, securing each block in place using corresponding hook and loop material strips. Next, the user folds the foam pad in thirds as shown. Finally, the user tucks the extended portion of the pillow covering 290 underneath the folded pillow to hold the pillow in the folded configuration.

An alternative embodiment of foam pillow that is not foldable is also contemplated wherein the alternative embodiment pillow is wholly comprised of various sized and configured covered foam blocks that can be stacked and joined together using hook and loop strips to form a resulting pillow of a user's desired configuration.

A Seventh Preferred Embodiment of the Pillow

Figure 17:
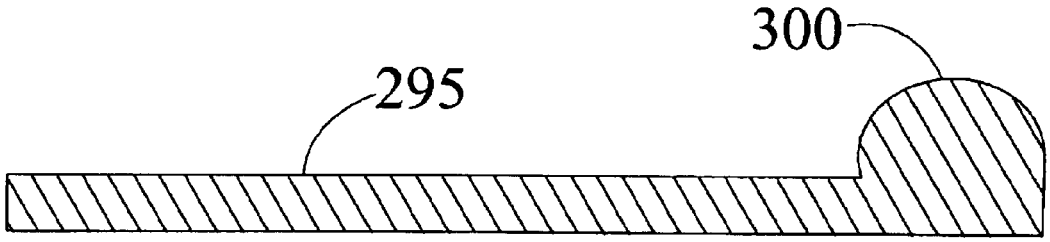
FIG. 17 is a cross sectional side view of a seventh preferred embodiment of the foldable pillow of the present invention.

FIG. 17 illustrates the foam pad 295 of a seventh preferred embodiment pillow. The pillow covering has been omitted for clarity but the pillow covering of the first and third preferred embodiments can be utilized with the pad of this embodiment. The pad 295 includes a molded or otherwise formed bulge 300 at one end of the foam pad. The bulge is preferably at least partially cylindrical and when the pillow is folded it provides for the additional thickness of the thicker neck section. In an alternative embodiment somewhat related to the seventh preferred embodiment a separate cylindrical piece of foam can be used in conjunction with a foam pad, such as the pad 105 of the first preferred embodiment, to create the thicker neck section of the resulting folded neck pillow.

An Alternative Embodiment Non-Folding Pillow

Figure 7:
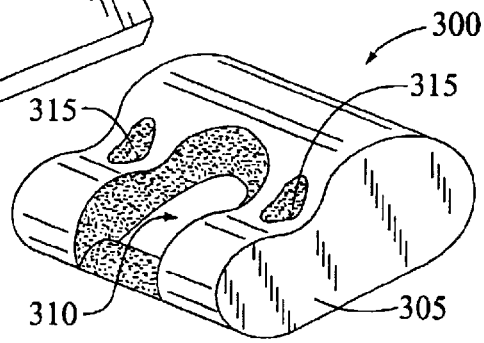
FIG. 7 is an isometric view of an alternative embodiment of the pillow.

FIG. 7 illustrates a third preferred embodiment pillow that is substantially different from the first and second preferred embodiments in that it comprises a block 305 of foam material, preferably viscoelastic foam, instead of a pad 105 or 205 that can be folded and rolled to product different pillow configurations. Essentially, the third preferred embodiment comprises a pillow formed from the aforementioned foam block material in any suitable form, whether that be generally rectangular, generally kidney-shaped, or another form, that includes partial cutouts 310 and/or 315 for receiving the head and/or ears of a user therein. A fabric cover, although not illustrated can be provided to add a layer of protection for the foam block and make the pillow's surface more comfortable to a user.

The head cutout 310 is generally similar in length and width to the head cutaway 210 of the second preferred embodiment. Similarly, its purpose is to cradle the head of a user therein. The head cutout differs from the head cutaway in that it does not extend all the way through the associated foam block. Rather, the cutout typically extends into the foam 2" to 3" leaving approximately 1.5" to 2" of material between the bottom surface of the cutout and the bottom surface of the foam block. Of course, the dimensions and configuration of the cutout can vary.

The ear cutouts 315 are located on either side of the head cutout 310 and have similar dimensions as the ear cutaways 215 of the second preferred embodiment. However, unlike the ear cutaways, the ear cutouts do not extend all the way through the associated foam block but rather extend inwardly a relatively short distance such a 0.75" to 1.5", although the dimensions can vary.

The third preferred embodiment offers a pillow that is typically suitable for both back and side sleepers and more particularly is suitable for switch-position sleepers that utilize both the side and back sleeping positions. Normally, a user would place his/her head in the head cutout 315 when sleeping on his/her back, and roll into the side sleeping position when desired such that a user's ear is positioned directly above one of the ear cutouts 315 to prevent the creation of a pressure point at the ear.

Other Alternative Embodiments

The embodiments of the pillow as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

I claim:

1. A combination comprising: a pillow; and instructions, wherein the instructions direct how to fold or roll the pillow into three or more configurations, and wherein the pillow comprises:

a generally rectangular pad having (1) a substantially planer top surface, (2) a substantially planer bottom surface generally parallel to and spaced from the top surface by a pad thickness, (3) a pad length, (4) a pad width, the pad length being at least seventy five percent longer than the pad width, (5) first and second side surfaces extending between respective lengthwise edges of the top and bottom surfaces, and (6) third and fourth side surfaces extending between extending between respective widthwise edges of the top and bottom surfaces; and a textile pillow covering substantially encapsulating the pad, the pillow covering having a pillow covering length, the pillow covering length being at least 20% longer than the pad length.

2. The combination of claim 1, wherein the flat pad comprises a foam material.

3. The combination of claim 2, wherein the foam material comprises a viscoelastic foam.

4. The combination of claim 3, wherein the viscoelastic foam has a density of between about 2.5 and 4.5 pounds.

5. The combination of claim 2, wherein the top surface is substantially smooth, and the bottom surface is textured.

6. The combination of claim 5, wherein the texture of the bottom surface is an eggcrate texture.

7. The combination of claim 1, wherein the pad thickness is between about 0.75" and 1.5".

8. The combination of claim 1, wherein the pad length is between 44" and 52", and the pad width is between 18" and 25".

9. The combination of claim 1 wherein the pad further includes a first cutaway section, the cutaway section extend inwardly from the third side surface, the first cutaway section having (i) a cutaway length generally corresponding to the length of a human head, and (ii) a cutaway width generally corresponding to the width of a human head, the cut defining a first portion of the pad between the cutaway and the first side surface and a second portion of the pad between the first cutaway section and the second side surface.

10. The combination of claim 9, wherein the pad further comprises corresponding second and third cutaway sections, the second section being located in the first portion and the third cutaway section being located in the third portion, the second and third cutaway sections having a size generally corresponding to the size of a human ear.

11. The combination of claim 1, wherein one or more of the plurality of side surfaces are generally perpendicular to the top surface.

12. The combination of claim 1, wherein the pillow covering is comprised of a woven or non-woven fabric material.

13. A method of using a flat pillow wherein the flat pillow comprises a rectangular pad having generally planer top and bottom generally parallel surfaces separated by a thickness not exceeding two inches and a pillow length at least seventy five percent longer than a pillow width, the method comprising:

forming the pillow by first folding the pillow widthwise at one or more locations, the one or more locations being a relatively short distance from a first widthwise edge of the pillow to form a first folded portion, next generally evenly folding a remaining length of the pillow over the first folded portion and on to itself at two or more locations thereby covering the first folded portion and forming a second folded portion, whereby the formed pillow includes a thicker section and a thinner section, the thicker section comprising both the first and second folded portions and the thinner section comprising only the second folded portion;

positioning the pillow on a sleeping surface; and laying down on the sleeping surface and placing a head on the formed pillow.

14. The method of claim 13, wherein the pillow further includes a pillow covering substantially encapsulating the pillow, the pillow covering having a length that is at least about twenty five percent longer than the pad, and the method further comprises wrapping a portion of the pillow covering comprising an additional length in excess of the length of the pad between a bottom surface of the formed pillow and the sleeping surface.

15. The method of claim 13, said placing a head in the pillow further comprises placing a neck over a thicker section of the formed pillow and placing the head on a thinner section of the formed pillow, the thicker section including both the first and second folded portions and the thinner section including only the second folded portion.

16. The method of claim 13 further comprising securing the formed pillow using several patches of hook and loop material located proximate lengthwise edges of the pillow.

17. A combination comprising:

A pillow including a generally viscoelastic foam pad, the pad having (1) a substantially planer top surface, (2) a substantially planer bottom surface generally parallel to and spaced from the top surface by a pad thickness of about 0.75" to 1.75", (3) a pad length of about 44" to 52", (4) a pad width, the pad length being at least seventy five percent longer than the pad width; and instructions directing how to fold or roll the pillow into three or more configurations including a first configuration wherein the pillow formed into the first configuration includes a first folded portion and a second folded portion, the first folded portion comprising a section of the pillow folded at one or more locations proximate a widthwise end of the pillow, the second folded portion comprising a remaining section of the pillow folded approximately evenly over on to itself at two or more widthwise locations wherein the second folded portion substantially encapsulates the first folded portion.

18. The combination of claim 17, wherein the pillow further includes a pillow covering.

19. The pillow of claim 17, further comprising several patches of hook and loop material located proximate lengthwise edges of the pillow.

* * * * *